US010465360B2

(12) United States Patent
Dunst

(10) Patent No.: US 10,465,360 B2
(45) Date of Patent: Nov. 5, 2019

(54) CABLE-LAYING DEVICE AND METHOD

(71) Applicant: LAYJET MICRO-ROHR VERLEGEGESELLSCHAFT M.B.H, Ebersdorf (AT)

(72) Inventor: Wolfgang Dunst, Kaindorf (AT)

(73) Assignee: LAYJET Micro-Rohr Verlegegesellschaft m.b.H., Ebersdorf (AT)

( * ) Notice: Subject to any disclaimer, the term of this patent is extended or adjusted under 35 U.S.C. 154(b) by 0 days.

(21) Appl. No.: 16/331,548

(22) PCT Filed: Aug. 18, 2017

(86) PCT No.: PCT/AT2017/060205
§ 371 (c)(1),
(2) Date: Mar. 8, 2019

(87) PCT Pub. No.: WO2018/045404
PCT Pub. Date: Mar. 15, 2018

(65) Prior Publication Data

US 2019/0211527 A1 Jul. 11, 2019

(30) Foreign Application Priority Data

Sep. 8, 2016 (AT) ..... A 50797/2016

(51) Int. Cl.
*E02F 5/10* (2006.01)
*E02F 5/08* (2006.01)
(Continued)

(52) U.S. Cl.
CPC ..... *E02F 5/101* (2013.01); *E02F 5/08* (2013.01); *E02F 5/12* (2013.01); *E02F 5/145* (2013.01)

(58) Field of Classification Search
CPC ..... E02F 5/101; E02F 5/08; E02F 5/13; E02F 5/145
See application file for complete search history.

(56) References Cited

U.S. PATENT DOCUMENTS 3,203,188 A 8/1965 Evans
3,332,249 A 7/1967 Idoine
(Continued)

FOREIGN PATENT DOCUMENTS

DE 2504598 A1 8/1976
DE 102014105577 A1 10/2015
(Continued)

*Primary Examiner* — Benjamin F Fiorello
(74) *Attorney, Agent, or Firm* — Laurence A. Greenberg; Werner H. Stemer; Ralph E. Locher

(57) ABSTRACT

A mobile device for the underground laying of a flexible line, a cable, a cable-pulling empty pipe or fluid transport tube. A front vehicle has a rear support frame, a lateral ejection unit, a milling unit with a milling wheel and a drag formwork or cable laying unit following the wheel. The milling unit is connected to the front vehicle for lateral pivoting up to ±25°, in particular up to ±20°, is laterally offset towards the outside with respect to the front vehicle, and can be positioned to laterally protrude over the contour of the front vehicle, by a primary articulation or a swivel joint on the lateral ejection unit having a substantially vertical axis of rotation. The drag formwork, cable laying and cable introducing unit follows the milling unit and the cable introducing unit are also laterally pivotable about a second swivel joint.

13 Claims, 6 Drawing Sheets

(51) Int. Cl.
*E02F 5/14* (2006.01)
*E02F 5/12* (2006.01)

(56) References Cited

U.S. PATENT DOCUMENTS

| | | | | | |
|---|---|---|---|---|---|
| 4,812,078 | A | | 3/1989 | Rivard | |
| 4,871,281 | A | | 10/1989 | Justice | |
| 5,070,632 | A | * | 12/1991 | Gilbert | E02F 5/06 37/360 |
| 5,271,168 | A | * | 12/1993 | Wilson, Sr. | B07B 1/005 209/257 |
| 5,573,347 | A | * | 11/1996 | Miles | E02B 11/00 105/179 |
| 5,575,538 | A | * | 11/1996 | Gilbert | E02F 3/20 299/39.2 |
| 5,743,675 | A | | 4/1998 | Fluharty et al. | |
| 6,189,244 | B1 | | 2/2001 | Johnson et al. | |
| 6,457,267 | B1 | | 10/2002 | Porter et al. | |
| 2010/0104374 | A1 | | 4/2010 | Hall | |
| 2012/0099929 | A1 | * | 4/2012 | Baber | E02F 3/962 405/184.4 |
| 2015/0252551 | A1 | | 9/2015 | Quackenbush et al. | |
| 2017/0036602 | A1 | * | 2/2017 | Kroll | B60R 1/00 |

FOREIGN PATENT DOCUMENTS

| | | | |
|---|---|---|---|
| EP | 0585188 | A1 | 3/1994 |
| EP | 2239377 | A1 | 10/2010 |
| FR | 2722809 | A1 | 1/1996 |
| GB | 410900 | A | 5/1934 |
| JP | S58029924 | A | 2/1983 |

* cited by examiner

CABLE-LAYING DEVICE AND METHOD

BACKGROUND OF THE INVENTION

Field of the Invention

The present invention relates to a new labor-effective and cost-effective device for laying cables, lines, cable-drawing hoses, fluid hoses and/or the like underground.

For a long time, with regard to laying cables, lines or hoses, for various reasons, there has been a tendency to not route said cables, lines or hoses above ground or via masts, but rather to lay them in the ground.

In this manner, the advantage is provided that mast foundations, which for example impede agricultural activity, and have unsightly masts and overhead lines, which spoil the landscape, are no longer required, and that the increasingly intensive requirements in terms of environmental protection, to reduce electrosmog, can be met.

Of course, when laying for example high-voltage cables underground, there are considerable cost increases, and accordingly, there have been many attempts to get a grip on said costs by streamlining the line-laying process, in particular by reducing the previously required human labor input.

With regard to the topography of the guidance of lines, in particular fiber optic cables, in rural areas, in particular for the purpose of firstly preventing development and construction work which disrupts field work and secondly achieving the most effective approach possible, it has proven to be advantageous to lay cables and lines underneath the verges which are at the side of roads and routes, which has the disadvantage that the laying route is usually higher, but ultimately, the substantial advantage is achieved that work can be carried out by means of conventional, roadworthy vehicles which can move on or along the roads without having to leave said roads.

When laying the cables and/or the like underneath the verges which are at the side of traffic routes, there is no need to open up and restore the road surface itself, the vehicles comprising the laying devices move slowly along the roadside and thus impede normal road traffic during the cable-laying work to only a minimal extent.

The conventional approach up to now for laying cables underground substantially consists in the fact that, in the ground, by means of a wheel milling cutter, a narrow trench having a laying depth which is required or desired in each case is deepened, the soil material which is milled out in the process is deposited to the side thereof, and the cable and/or the like, preferably together with a warning tape, is inserted in the trench in the correct position, after which, firstly while additionally embedding the introduced cable and/or the like, cable sand is introduced into the trench, and then the milled-out soil material previously deposited to the side of the trench is reintroduced into said trench, and optionally at least compacted from above.

Up to now, the cable trench was firstly produced separately, e.g. by means of an excavator shovel, and the soil material produced in the process deposited to the side thereof, then the cable drum transported on a vehicle was mounted on an unwinding frame positioned over the trench and pulled off therefrom and deposited in the trench by the cable-laying team, then by means of—mostly manual—shoveling-in of cable sand, the cable was embedded in said trench, and lastly, likewise manually with shovels, the open trench was filled up with the previously excavated soil material.

As the prior art in this field, the following documents are cited:

U.S. Pat. Nos. 4,812,078 A, 3,203,188 A, 5,743,675 A, DE 2504598 A1, US 2010104374 A1, U.S. Pat. No. 3,332,249 A, GB410900 A, U.S. Pat. Nos. 6,189,244 B1, 4,871,281 A, 6,457,267 B1, DE 102014105577 A1, US 2015252551 A1 and JP S5829924 A.

The invention aims in principle to perform the described steps of cable laying as part of a continuous laying process with a minimum of physical labor and with comparatively substantially reduced time and effort.

SUMMARY OF THE INVENTION

A completely essential aim of the present invention is to provide a high-speed, highly flexible and simultaneously compact cable-laying device, by means of which it is made possible for the first time to lay cables and/or flexible lines practically along every traffic route of any, in particular winding, route, underneath the mostly narrow strips of road or verges thereof which do not directly belong to the roadway, in a precise manner and with a minimum of time and effort, but absolutely without damaging or otherwise adversely affecting the road foundation and the traffic region, that is to say in particular the road surface, in the process.

The invention thus relates to a new mobile device for laying at least one (flexurally) flexible line, a cable of this type, a cable-drawing empty pipe or fluid transport hose underground underneath the verges or strips of road which are at the side of traffic routes or roads, in the subsoil of the verge, by means of a wheel milling cutter of a milling unit, a narrow trench having a laying depth which is desired in each case to able to be deepened, the subsoil material which is milled out in the process being laterally removed, the cable or cables and the warning tape being able to be inserted in the trench in the correct position, in order to embed the introduced line/cable or the like, fine-particle subsoil material or cable sand being introduced into the trench, and then the previously laterally removed, milled-out subsoil material being able to be reintroduced into said trench and recompacted,

- the cable to be deposited being able to be pulled off and inserted in the just produced cable trench by a vehicle driving at low speed, in sync with the driving speed of the front vehicle, and
- by means of an ejection gutter or channel routed above the cable trench, amounts of fine material or cable sand, which are continuously adjusted to the current driving speed in each case, being able to be introduced into the cable trench, which is characterized in that
- in particular for laying the cable along a winding traffic route, the front vehicle in the form of a carrier vehicle, together with a rear carrier or support frame comprising a lateral ejection unit having a milling unit which is hingedly attached thereto, having a milling wheel and a tow-casing and cable-depositing unit following said unit, altogether forms a mobile, mechanical complete or compact unit which can negotiate curves,
- inside which unit the milling unit and, together therewith, the milling wheel, is connected to the front vehicle or to the carrier thereof in such a way that it can pivot laterally up to an angle of up to ±25°, in particular up to ±20°, towards both sides in a laterally offset manner towards the outside with respect to the front vehicle, and can be positioned so as to laterally protrude beyond the lateral contour of the front vehicle by means of a first linkage or a rotational joint on a lateral ejection unit having an axis of rotation which is substantially vertical with respect thereto, the tow-casing and cable-inserting and cable-sand-introduction unit following the milling unit in turn being connected to the milling unit so as to be able to pivot laterally in each case at an angle of up to ±25°, in particular up to ±20°, towards both sides likewise by means of a second linkage or a rotational joint having an axis of rotation which is substantially vertical with respect thereto.

In order to keep all the wheels of the traction or front vehicle securely on the solid road foundation and in particular completely on the road surface during the laying process, that is to say during the laying journey, and thus safely protect said surface, but simultaneously cut the cable trench into the verge, in the case of the device according to the invention, it is provided that the milling unit which can pivot laterally at an angle and comprises a milling wheel is linked to a lateral ejection device which is connected to the front vehicle or to the support frame thereof and can be adapted to the topographical conditions which are defined by the existing verge to be undercut, preferably can be laterally displaced—at least to one side—in a linear manner, preferably hydraulically, with respect to the front vehicle, To safely keep firstly the actual roadway foundation and secondly the cable trench stable during the laying process itself, it has proven to be particularly advantageous to ensure that, in particular to stabilize and keep stable the walls of the trench just produced in each case, the tow-casing and cable-inserting unit is equipped with sheet metal form plates on both sides, of which the distance from one another can optionally be adjusted to the respective trench width, and towards the milling wheel of the milling unit, reaches said milling wheel rising in concave curves, in as short a distance as possible, preferably up to approximately 10 cm.

Since the composition and the foundation structure of the verges which are at the side of traffic routes is not known in advance, and in the course of the trench milling, the milling wheel can become blocked, e.g. by boulders, rock, buried objects or the like, which disrupts the laying operation, in the context of the invention, there is an essential advantage when the milling device and/or the milling wheel thereof, for example in the case in which said wheel is blocked by hard subsoil material, can be lifted without changing the vertical position, in the trench, of the tow-casing and cable-inserting unit, which is connected to the milling unit so as to be able to pivot laterally and comprises the sheet metal form plates on both sides which practically ensure the stability of the trench throughout.

In this case, it is particularly advantageous for a parallelogram mechanical system for lowering or lifting the tow-casing and cable-inserting unit, in particular for lifting the milling unit, optionally together with the milling wheel, out of the trench in the event of a blockage, to be linked on both sides to the rotational joint for the tow-casing and cable-inserting unit on the milling unit or on the housing thereof.

For the purpose of saving material and reinstatement costs, one embodiment of the new device is particularly valuable, according to which a conveyor belt which is to be loaded with the trench excavation material is attached to the side of the milling wheel of the milling unit of the milling housing, which conveyor belt an elongate star screen, preferably rising obliquely, follows, which screen comprises a plurality of rotatable screening stars mounted on axes of rotation which are transverse to the transport direction thereof and arranged at different distances from one another, for the transport of the verge subsoil, that is to say trench excavation material excavated by the milling wheel backwards for the final filling of the just produced cable trench.

In this case, it is preferably provided that a conveyor belt for transporting away backwards the fine-particle trench material separated from coarse trench material by means of said conveyor belt is arranged underneath the elongate star screen.

Advantageously, it is provided that, by means of the conveyor belt arranged underneath the star screen, a fine screen can be loaded with the fine-particle excavation material, and that the separated, particularly fine-particle or finest-particle, substantially sand-like, fine trench material can be used at least in part instead of separately supplied cable sand, or said material can additionally be used for embedding and surrounding the cable and/or line deposited in the cable trench.

To allow finest-particle, sand-like cable-embedding and surrounding material from the trench to be introduced into the trench at an adequate speed and in sync with the driving speed, it has proven to be advantageous to ensure that, in the chute or ejection gutter directed over the trench for this particularly fine-particle, substantially sand-like trench excavation material, a trench and cable and/or line which bridges the cross section of the chute and which releases a variable-height opening in the lower face thereof, has a height which can be adjusted to the demand in each case per running meter of trench and cable for fine cable-embedding and surrounding material per running meter of trench and cable and/or line.

The invention thus relates to a device by means of which, in the clearance gage of a road, cables and various lines can be laid without for example damaging the asphalt roadway or making the roadway unstable in any way in the process.

As a result of the usually slim structural width, this takes place in the range of approx. 30 cm and a trench width of for example 13 to 17 cm while providing the best possible protection of the lateral road equipment such as reflector posts and road signs. By means of the two rotational joints in the new compact cable-laying unit, lines can be laid along the curves of each road constructed according to guidelines without any problems.

By laterally extending the milling unit and, together therewith, the entire compact unit, over and onto the verge, it is ensured that the front or carrier vehicle always moves on the load-bearing roadway, while milling can be carried out in the lateral edge strip, that is to say the verge. The mounted tow-casing unit, which is preferably connected to the housing of the milling unit on the rotational joint directly behind the milling wheel by means of a parallelogram mechanical system, ensures that the roadway cannot wash away to the sides and thus remains completely load bearing and stable throughout the laying process.

In addition, by means of the guide rollers inside the tow-casing unit, it is ensured that the cables or lines are laid without kinks, and lastly, it is made possible to cover the cables and/or lines by introducing sufficiently fine-grained excavation material and/or cable sand into the trench.

The milled-out trench material is laterally deposited onto a two-part conveyor belt and reintroduced into the trench immediately behind the tow-casing unit, whereby, after the cable laying has taken place, said trench is immediately closed up again. As a result, the stability of the roadway is completely maintained throughout the laying process. As a result of sifting out fine material, grains which are suitable for road construction can be produced on site, depending on the material which is available in each case.

The invention is based on and additionally essentially relates to a—not-yet-perfected—new cable-laying method of the type described at the outset which is characterized in that, along a cable-laying stretch provided in each case, in particular along a road verge, a cable-laying train, comprising two vehicles driving one behind the other at a short distance from one another, is moved forwards, the first vehicle thereof, driving at low speed, carrying the cable drum supplying the cable and/or the like and thereby excavating the cable trench by means of a trench milling cutter which is drivingly connected thereto, the milled-out excavation material being conveyed backwards in each case by means of a conveyor belt which is attached to the side of said trench milling cutter, in that the cable and/or the like which is pulled off or to be pulled off the cable drum in sync with the driving speed of the first vehicle is inserted in the just produced cable trench, in that, by means of an ejection gutter arranged on the rear side of the first vehicle, which gutter is guided by said vehicle precisely above the just produced cable trench and the cable and/or the like inserted in said trench, by the second vehicle, which follows the first vehicle at a, preferably constant, distance, has a driving speed which is in sync with the driving speed of said first vehicle, and is equipped with a sand conveyor belt or conveying hose which ends above the ejection gutter of the first vehicle, amounts of cable sand, which are continuously adjusted to the current driving speed in each case, per running meter of driving route are introduced into the cable trench through the ejection gutter, thereby embedding, surrounding and additionally embedding the cable and/or the like, in that immediately thereafter, the excavation material continuously conveyed backwards by means of the conveyor belt attached to the trench milling cutter is reintroduced into the cable trench—filling up said trench again—by means of a discharge chute of said conveyor belt.

This likewise new cable-laying method is characterized in particular by the rapid work progress which can be achieved thereby and, even if the technical complexity appears to be relatively high at first glance, this is more than compensated for by the cleanliness of the method and the comparatively high speed of implementing said method and of restoring the original state.

In the context of the invention, in particular for the purpose of achieving a high level of cleanliness during the implementation thereof, one embodiment of the invention has proven to be advantageous, according to which it is provided that, instead of the cable sand supply comprising a sand ejection gutter on the first vehicle and sand conveyor belt on the second vehicle, a sand conveying hose which is carried by said vehicle and the discharge end of which is oriented from above directly into the just milled-out cable trench is provided, by means of which hose the cable sand is blown into the cable trench directly onto and around the cable and/or the like just inserted in said cable trench. In this case, it is achieved that practically no amount of cable sand lands anywhere other than in the cable trench, and cleaning work after the cable laying has taken place is practically omitted.

In the course of ground-cable-laying methods, it is now conventional to insert a warning tape in the trench above the laid cable, by means of which tape the cable and/or the like located underneath said tape is protected as much as possible against damage or potentially even breakage in the case of subsequent excavation, restoration or expansion work using mini-excavators or the like.

Accordingly, in the context of the invention in question, it is preferable to ensure that, by the first vehicle of the cable-laying train, substantially in sync with the cable and/or the like, preferably in the course of introducing the cable sand from the second vehicle, or immediately following said introduction, and before reintroducing the loose milled-out soil material by the conveyor belt of the trench milling cutter of the first vehicle, the warning tape is introduced into the cable trench above the cable and/or the like in the correct position in the cable trench.

A completely essential part of carrying out this cable-laying method is a new type of cable-laying train which is characterized in that the entire cable-laying train which can be driven at low speed is formed with a front, first vehicle, in particular a tractor, from the cable drum of which, the front side of which drum is preferably to be mounted in a bearing bracket and, preferably by means of guide rollers which are arranged above and on the rear thereof, the cable and/or the like to be laid can be pulled off at a speed, corresponding to the current driving speed in each case, and inserted in the cable trench just excavated by means of a trench milling cutter, which is likewise arranged on the first vehicle, a conveyor belt being attached to the side of the trench milling cutter for conveying the loose just milled-out soil material backwards, and furthermore, the first vehicle carrying, on the rear side thereof, a sand ejection gutter which can continuously be carried above the cable trench in each case, and in that the cable-laying train comprises a second vehicle following the front, first vehicle at a, preferably constant, short distance, which second vehicle is suitable for receiving and transporting fine cable sand, said second vehicle being in particular a heavy goods vehicle having a transport trough, having a sand conveyor belt or sand conveying hose coming off the sand discharge and dosing device thereof, and the free discharge end of which is to be positioned above the sand ejection gutter in the rear region of the first vehicle, for conveying the cable sand forwards and for the introduction thereof through the sand ejection gutter into the cable trench, the previously milled out, loose soil material being able to be supplied back into the cable trench by the discharge chute, which is arranged lagging the sand ejection gutter, of the conveyor belt of the trench milling cutter of the first vehicle.

For the purpose of optimizing cable sand consumption, it is advantageous for the sand discharge and dosing device of the second vehicle to be equipped with a dosing device, which can preferably be controlled from said vehicle, for regulating, according to and in sync with the driving speed, the amount of cable sand delivered per running meter of laying stretch covered in each case.

With regard to maintaining the constant distance between the first and the second vehicle, it has proven to be advantageous to ensure that at least one of the two vehicles, preferably both vehicles, is or are equipped in each case with a continuously variable (hydraulic) or hydrostatic drive which can preferably be controlled from the second vehicle.

In order to practically completely reinstate the original state after the cable laying has taken place, it is more preferably provided that the second vehicle is equipped with a vibrating and tamping member for compacting the previously milled-out, loose soil material which has been conveyed back into the previously produced cable trench.

The maintenance of the constant distance between the first and the second vehicle during the forwards movement thereof taking place in sync at low speed is ensured by a computer-controlled driving speed synchronization device, which is preferably arranged in the second vehicle, and by means of which the output of the cable sand, which can be dosed according to the speed, per running meter of cable-laying stretch out of the trough of the second vehicle into the cable trench can be regulated. Of course, the new cable-laying train has at least one GPS sensor so that the topographical course of the laid cable and/or the like can be precisely determined and registered so that said course can be precisely reconstructed and retraced for subsequent adaptation processes or the like without any problems.

The invention and the starting invention will be described in greater detail with reference to the drawings:

BRIEF DESCRIPTION OF THE SEVERAL VIEWS OF THE DRAWING

FIG. 1 shows the new laying-device according to the invention in a plan view, FIG. 2 shows said device in a side view from the road, FIG. 3 shows said device in a side view from outside towards the road, and FIG. 4 shows said device in a rear view, and FIGS. 5 and 6 illustrate the second subject matter of the invention from which the present invention proceeds.

DESCRIPTION OF THE INVENTION

Figure 1:
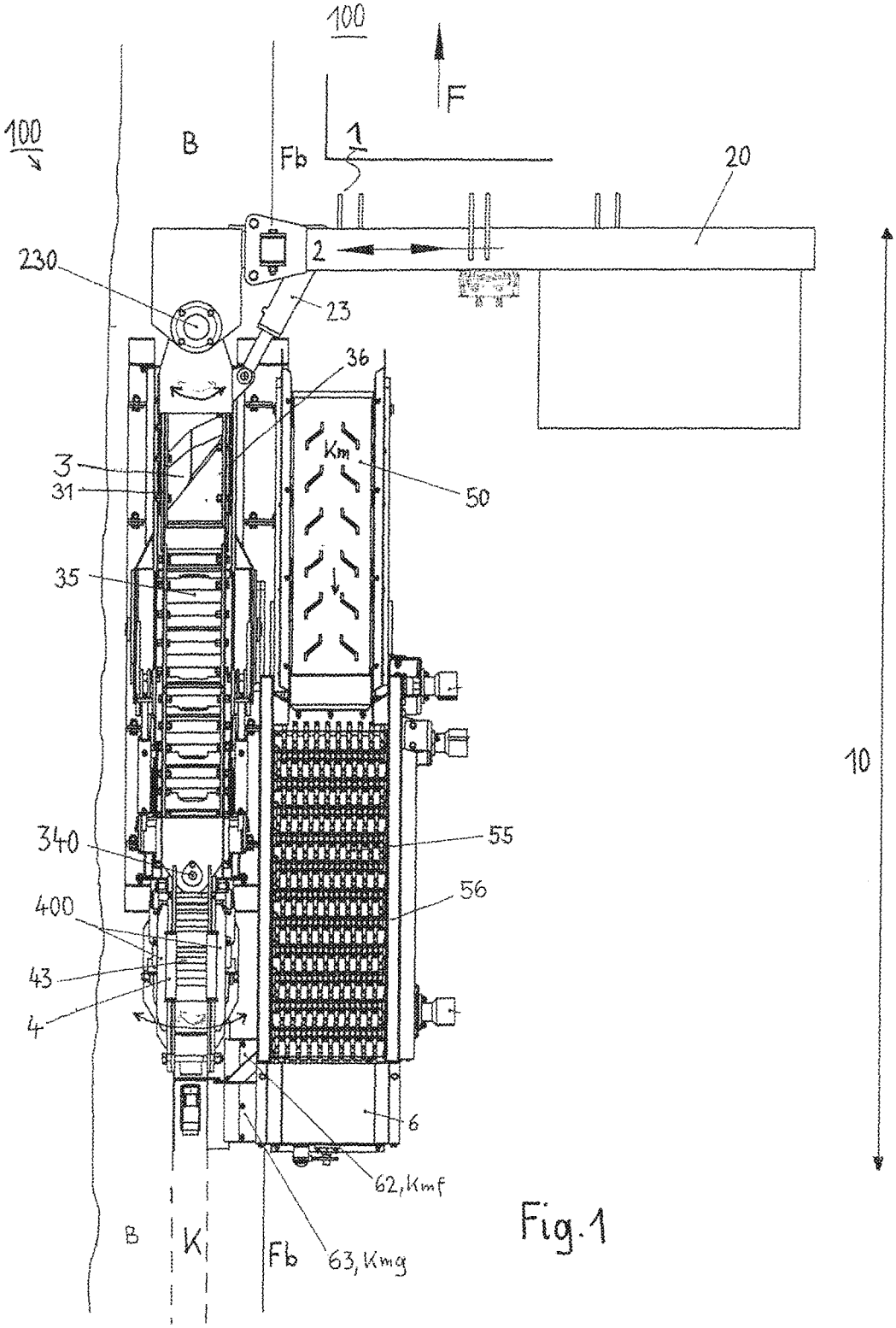
FIGS. 1 to 4 show, on the basis of views from above, from both sides, and from behind, the structure of the new compact cable-laying device as claimed.

FIG. 1 shows how a carrier or support frame 20 comprising a lateral ejection device 2 which, as indicated by a double arrow, can be moved sideways in a linear manner in both directions, is attached to the rear side of a towing vehicle 1 which is indicated only schematically per se, is driving in the driving direction F and is remaining strictly on the road surface covering Fb, for example a tractor.

By means of two attachments which are at a distance from one another and protrude backwards from the excavation device 2, of which in this case only the upper attachment is visible, a linkage formed by the first rotational joint 230 having a substantially vertical axis is supported, about which axis the trench milling unit 3, together with the housing 31 thereof and the trench milling wheel 35, can laterally pivot at an angle to the right or left, as indicated by the curved double arrow.

By means of hydraulic cylinders 23 fixed to the ejection device 2 and to the milling housing 31, the lateral pivoting angle can be adjusted according to the curve shape.

On the rear side of the milling unit 3, a second linkage which is formed by a rotational joint 340 is arranged, by means of which linkage the tow-casing and cable-inserting unit 4 directly following the milling unit 3 can pivot laterally likewise at an angle both to the right and to the left with respect to the milling unit 3. This lateral pivotability is also indicated by a curved double arrow.

The rollers 43 which are arranged inside the tow-casing and cable-inserting unit 4 for kink-free guidance of the cable L to be laid (not shown here) can clearly be seen from above the units 3 and 4 downwards into the cable trench K just produced by the cable-laying device 100 or the milling unit 3 thereof and cut into the verge B.

The tow-casing and cable-inserting unit 4 can be lowered with respect to the milling unit 3 by means of the two parallelogram mechanical systems 400 and is supported on the bottom of the trench, whereby the milling unit 3 is lifted.

Arranged or extending to the right, along the new complete or compact laying unit 10, which is formed comprising a lateral ejection device 2 a milling unit 3 and a tow-casing unit 4, and is doubly pivotable per se, of the new cable-laying device 100, a first conveyor belt 50 taking coarse-to-fine-grained trench material Kmg+Kmf=Km which is excavated by the trench milling wheel 35 through an ejection recess 36 in the milling unit housing 31 and ejected sideways–in this case continuously to the right–backwards is arranged, to which conveyor belt an elongate star screen 55 is connected, by means of which screen the separation of the fine-grained trench material Kmf from the coarse trench material Kmg takes place, the fine-grained trench material Kmf falling between the screening stars 51 downwards onto a second conveyor belt 56 (not visible here) and likewise being transported backwards by said belt while the coarse-grained trench material Kmg remains on the star screen 55 and is likewise taken backwards.

Inside the enclosure 6, the two material flows Kmf and Kmg reach two drop chutes 62, 63, the fine and finest material Kmf entering the trench K before the coarse material Kmg locally and temporally and embedding and surrounding the cable inserted therein, and the final filling of the trench K with coarse material Kmg, which optionally additionally contains excess fine material Kmf, taking place only thereafter.

Figure 2:
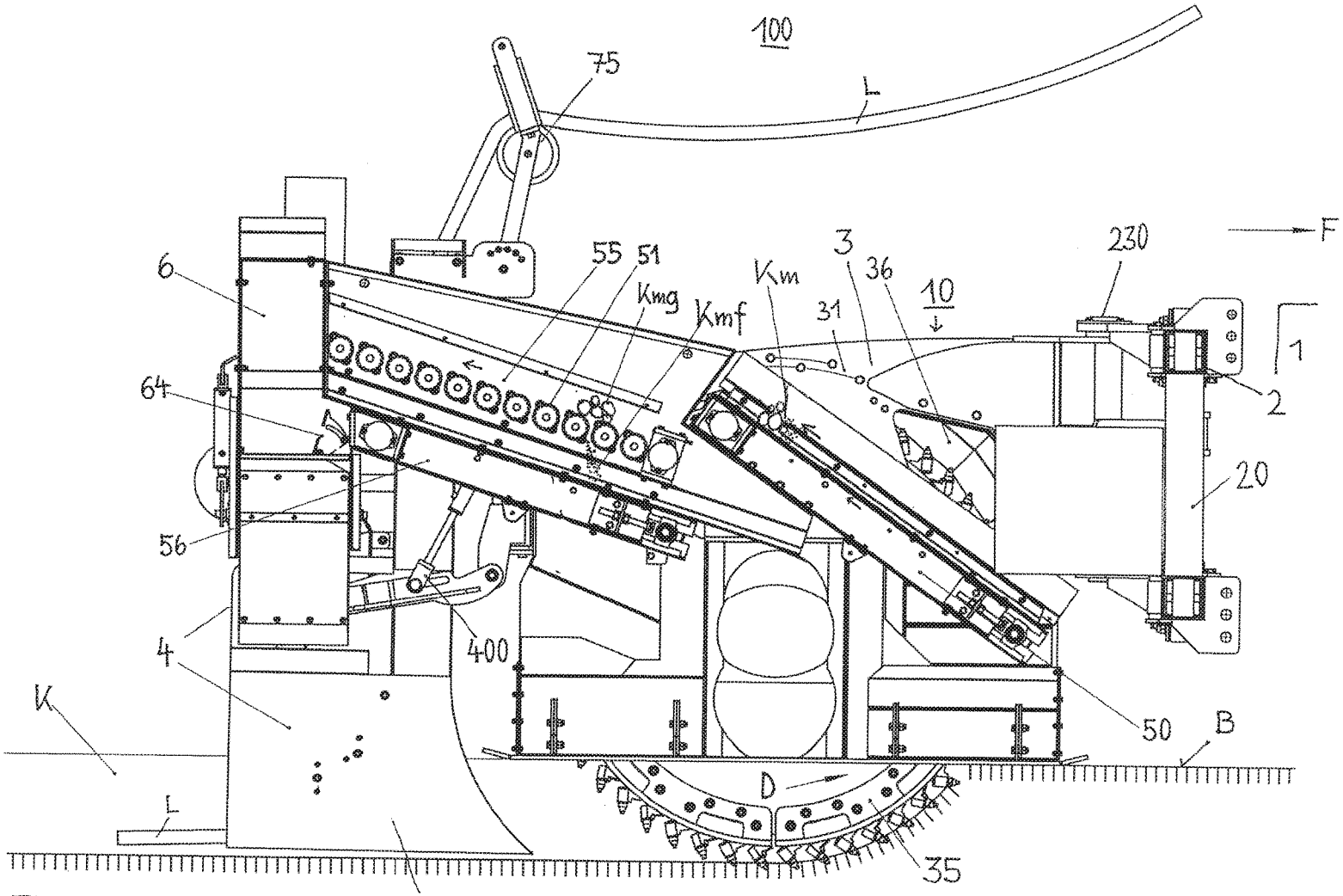

FIG. 2 clearly shows—the reference sign meanings otherwise remaining the same—viewed from the right with respect to the driving direction F of the complete laying unit 10, the milling wheel 35 having the hard metal burrs and the ejection recess 36 in the housing 31 of the milling unit 3, by means of which all the trench excavation material Km reaches the first conveyor belt 50 and, rising from there, then reaches the star screen 55 comprising the plurality of rotatable screening stars 51.

Underneath the star screen 55, a second conveyor belt 56 runs parallel thereto.

While the coarse trench material Kmg is transported rising backwards by the star screen 55, the fine trench material Kmf falls through the star screen 55 onto the conveyor belt 56, and both material flows enter the drop box or enclosure 6 having a flow-splitting flap 64, from where, by means of the divided chutes 62, 63 (see FIG. 1) the fine trench material Kmf enters the trench K before the coarse trench material Kmg locally and temporally, in which trench the cable L is already deposited.

The supply of the cable L takes place above the laying unit 10, which cable is guided downwards by means of cable reels 75 and lastly enters the trench K by means of guide rollers (not visible here) inside the tow-casing unit 4. In this case, the hydraulic cylinder 405 of the parallelogram mechanical system 400 for lowering the tow-casing unit 4 is still visible throughout, which cylinder can be used for example to lift the milling unit 3 in the case of a blockage thereof.

Figure 3:
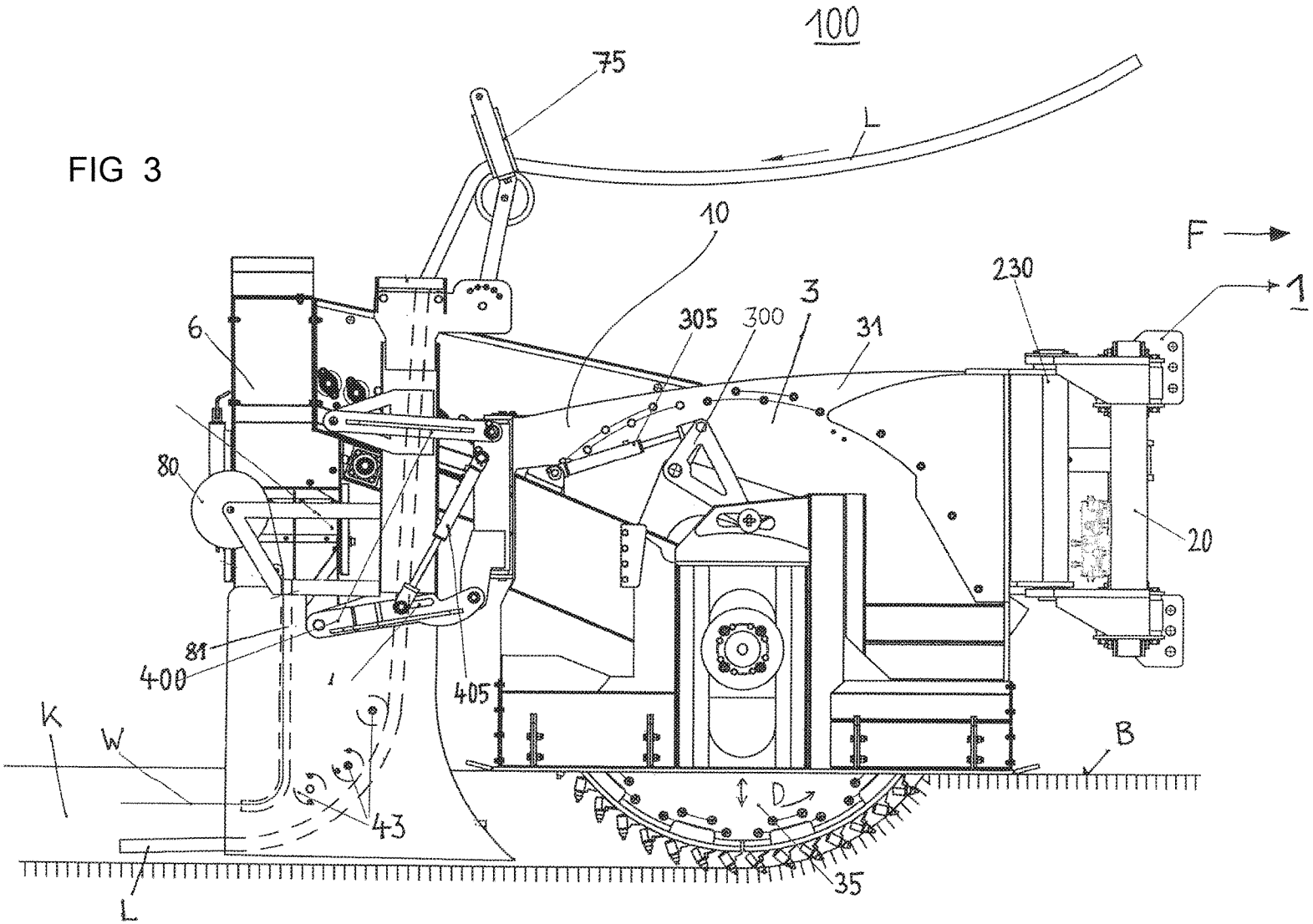

The side view from the left shown in FIG. 3 of the new compact cable-laying unit 10 which is movable per se—all other reference sign meanings remaining the same—makes it possible to clearly see the mechanical system 300 comprising hydraulic cylinders 305 for adjusting the depth of the milling wheel 35 with respect to to the milling unit 3.

The parallelogram mechanical system 400 comprising hydraulic cylinders 405 for the height adjustment of the milling unit 3 and tow-casing unit 4 relative to one another is clearly shown.

Furthermore, the route of the cable L to be laid over the upper roller 75 downwards through the tow-casing unit 4 and underneath the guide rollers 43 thereof is shown very clearly therein.

Furthermore, the unwinding drum 80 and the warning tape guide duct 81 for depositing the cable warning tape W above the cable L already deposited in the trench K is shown therein.

Figure 4:
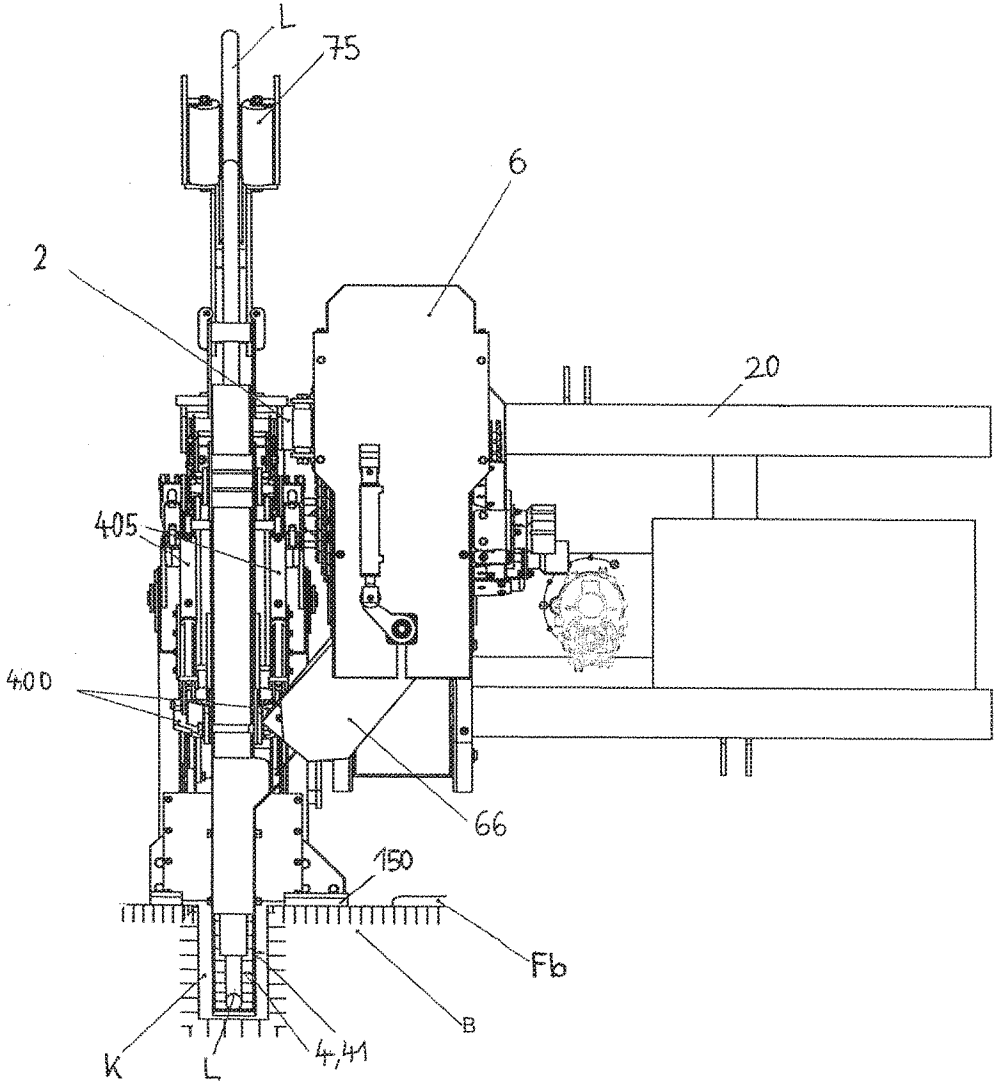

FIG. 4 shows—the reference sign meanings otherwise remaining the same—on both sides of the milling unit 3 and the tow-casing and cable-laying unit 4, the parallelogram mechanical system 400 for the mutual relative lifting or lowering of these two units 3 and 4 and the hydraulic cylinders 405 thereof and further shows the cable L guided above via the upper-side rollers 75, which cable is guided downwards through the unit 4 and is deposited between the two sheet metal form plates 41 on the bottom of the trench K.

Furthermore, the drop gutter 66 provided for coarse trench material and fine trench material separated therefrom is shown therein.

Clearly shown here are the two rails of the support frame 20 for the lateral ejection unit 2 and the actual edge of the roadway Fb, that is to say e.g. the asphalt layer of the road, which is absolutely not to touch or be touched by the new compact cable-laying unit 10, along which roadway the cable L is laid in the trench K produced in the verge B.

Each of the units 3 and 4 which is directly used when excavating the trench and laying the cable is equipped on the lower side thereof with a towing strip 150 which ensures the secure position of the just mentioned units on the verge B during the cable-laying journey.

All the essential new components of the cable-laying device according to the invention, summarized once again, include the following, reference being made to FIGS. 1 to 4.

a) Carrier frame 20
b) Lateral ejection device 2
c) Milling unit 3 having a milling wheel 35 and a housing 31
d) Tow-casing and cable-inserting unit 4
e) Conveyor belt 50 having a screening unit 55
f) Front or carrier device 1 a) Carrier Frame 20:

By means of the carrier frame 20 on the carrier or front vehicle 1, the milling unit 3 is connected to the milling wheel housing 31 thereof via a standardized three-point suspension. All the control and drive elements not shown in greater detail are located on the carrier frame 20. The lateral ejection unit 2 is integrated in the carrier 20 in the form of a tube-in-tube system, which is mounted on rollers.

b) Lateral Ejection Device 2:

The ejection device 2 can be laterally extended and retracted continuously by means of hydraulic cylinders. By means of the sideways extension of said device, it is possible for the milling unit 3 to be laterally pulled behind with respect to the carrier or front vehicle 1, and thus the milling of the trench K can take place precisely and without adversely affecting or damaging the road surface covering Fb or the like in the lateral strips of road or road verge B, and thus the roadway itself is not touched by the building work while the carrier or front vehicle 1 moves safely on the solid roadway in the driving direction F.

c) Milling Unit 3 and the Housing 31 thereof having a Milling Wheel 35:

The milling unit 3 or the milling housing 31 is connected to the lateral ejection device 2, 20 via the first rotational joint 230. An actuatable hydraulic cylinder, which is connected to the ejection device 2 and the milling housing 31, stabilizes said rotational joint. By means of the rotational joint 230, it is possible to mill narrow curves, since the milling housing 31 is pressed into the curve radius required in each case by means of hydraulic cylinders 23 of the ejection device 2, 20. A drive motor which is attached to the milling housing 31 axially drives the milling wheel 35. The milling wheel 35 is driven in the opposite direction to the driving direction F; see arrow D.

On the right-hand front side in the driving direction F of the milling housing 31, there is an ejection opening 36, through which the milled-out trench material Km is pressed. On the lower inner and outer face of the milling housing 31, there are two scraper bars which can press said material downwards or continuously lift said material by means of two hydraulic cylinders. The milling depth can thereby be changed continuously during the milling.

d) Tow-Casing and Cable-Inserting Unit 4:

This unit 4 completes three tasks:

Said unit is used as a clearing blade towards the milling wheel 35, it protects the trench K against collapse or being washed in, ensures that the cables and/or lines L are deposited in a protected manner and protects the lines L inserted in the trench K against the introduction of coarse material.

The tow-casing unit 4 is located or begins as directly as possible behind the milling wheel 35, and the concavely curved front face thereof is formed having a slightly greater radius towards said milling wheel 35 than the milling wheel itself. This shape of the tow-casing unit 4 prevents milled-out material on the rear side from ultimately being able to be reintroduced into the trench K.

Two lateral steel sheets 41 prevent the trench K from collapsing and unwanted verge subsoil or trench material Km from washing into the trench.

Between the two lateral sheet metal form plates 41 of the tow-casing unit 4, the guide rollers 43 which ensure the kink-free depositing of the cables and/or lines L are located. In addition, the tow-casing unit 4 protects the freshly laid lines L against the introduction of coarse material. The height-adjustable device 80, 81 on the rear side of the tow-casing unit 4 is used as a guide for depositing the warning tape W at the height desired in each case above the laid cable L inside the trench K.

The tow-casing unit 4 is connected by means of the parallelogram mechanical system 400 to the second rotational joint 340, which is attached to the milling housing 31. The rotational joint 340 allows the flexible guiding of the tow-casing unit 4 in curves in the trench K. The two lower carriers of the parallelogram mechanical system 400 are provided with a slot in which the ends of two hydraulic cylinders are attached by means of a pin. The other end of the hydraulic cylinders is attached to the rotational joint 340 on the right and left.

By means of the hydraulic cylinders 405, it is possible to continuously lift or lower the tow-casing unit 4.

If the milling wheel 35 comes to a standstill for example as a result of impurities of the verge subsoil, said wheel can be lifted by means of the depth-adjustment mechanical system 300 in order to restart.

Slots in the lower carriers of the parallelogram mechanical system 400 on both sides allow the relative lifting of the milling housing 3 without the tow-casing unit 4 itself thereby being lifted upwards. As a result, damage to the laid cables L and the collapse of the trench K are effectively prevented.

e) Conveyor Belt 50 having a Screening Unit 55:

The rising conveyor belt 50 is connected directly next to the upper ejection opening 36 in the milling housing 31 of the milling unit 3, which conveyor belt conveys the milled-out trench material Km towards the tow-casing unit 4. The screening device starts at the end of the conveyor belt 50, which device is particularly preferably formed by an elongate, further rising star screen 55.

The star screen 55 separates the trench material Km supplied thereto into fine and coarse particles Kmf and Kmg. The fine particles fall onto a conveyor belt 56 arranged underneath and are further transported backwards into a pivotable drop gutter.

The coarse material Kmg is likewise conveyed backwards into the drop gutter 63 during the screening process by the rotation of the screening stars 51. This pivotable drop gutter 63, which is located at the end of said screening device, allows the milled-out trench material to be deposited in a flexible manner.

The drop gutter can be pivoted towards the trench K or towards the roadway. The side of the drop gutter 63 which is tilted towards the trench K is divided into two grooves.

In a first groove in the driving direction, the sifted-out fine trench material Kmf is deposited, in the second groove, the coarse material Kmg is deposited. A height-adjustable deflector plate at the end of the first groove allows a dosed supply of the fine material Kmf via a cavity of the tow-casing unit 4 into the trench K. Excess fine material Kmf is conducted into the second groove by the deflector plate and, in said groove, mixes with the coarse material Kmg. By means of this grain mixture which is produced in the manner described, the trench K is lastly closed up.

f) Carrier or Front Vehicle 1:

Commercially available construction machines or tractors, which are preferably equipped with a continuous drive, are used as a carrier or front vehicle 1. On the front side of the carrier vehicle 1, there is a device which can receive the cable drums. By means of guide rollers above the compact cable-laying unit, the cables or lines L to be laid are guided into the tow-casing and cable-inserting unit 4 and inserted in the trench K therefrom.

By means of the combination of the described units 1, 2, 3, 4, it is ensured, with a high degree of safety, that in the edge strips or verge B of the traffic routes, lines and/or cables L can be laid without the roadway Fb being damaged in the process. This applies fully in particular in the curved regions of roads and the verges thereof.

Figure 5:
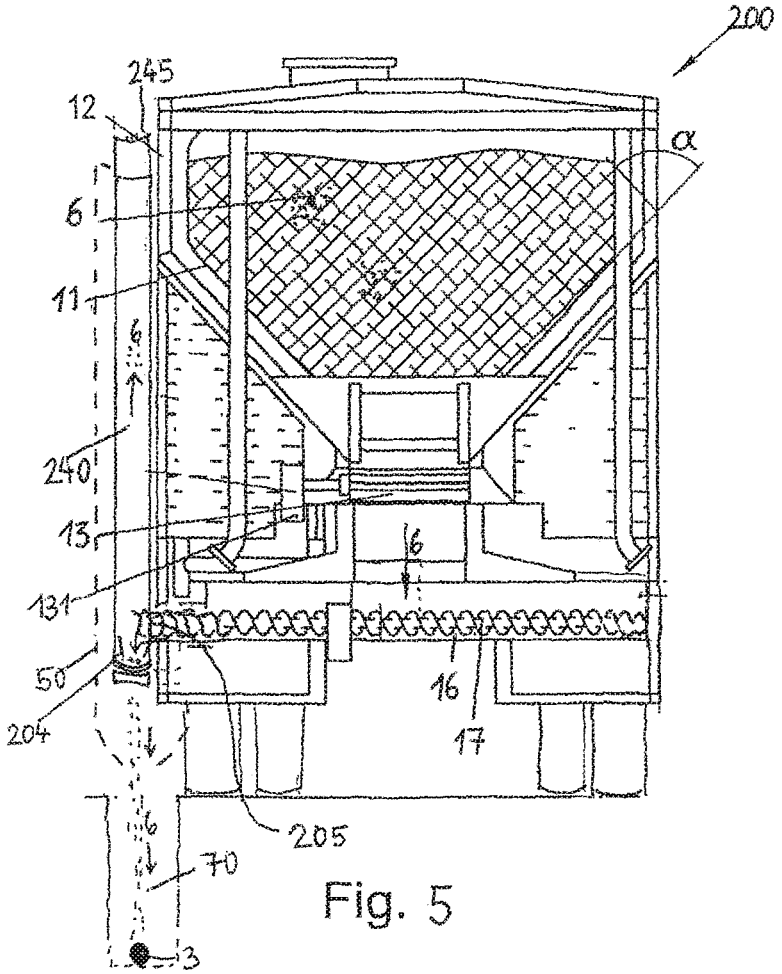
FIGS. 5 and 6 illustrate the second essential subject matter of the invention as claimed in greater detail.
Figure 6:
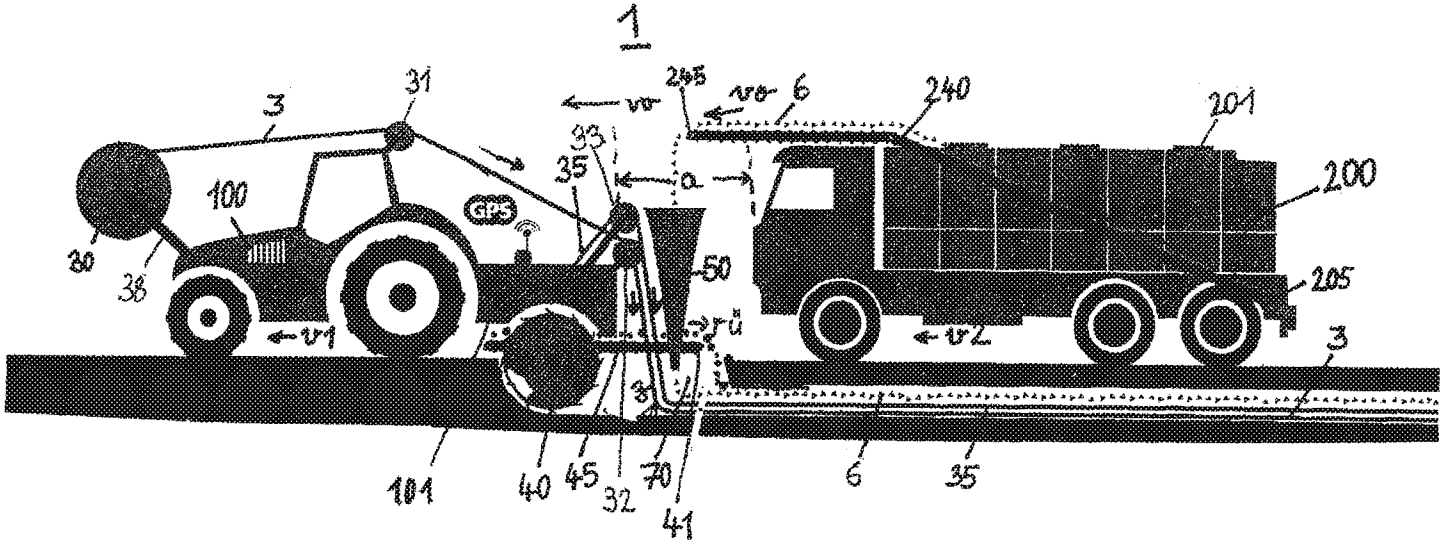

FIG. 5, which illustrates the starting invention, that is to say the second essential subject matter of the present invention, shows how a first vehicle 100 which is formed by a specially equipped tractor 100 and moves forwards vo at a speed v1 in the area of from 0 to approximately 4 km/h, supports, on the front side thereof, an unwinding bearing bracket 38 together with a cable drum 30 mounted thereon.

From said cable drum 30, by means of a roller 31, which is arranged above the driver's cab, the cable 3 to be laid underground is guided downwards by means of an additional roller 32 arranged on the rear side behind the tractor 100 and deposited in the cable trench 70 which has been freshly excavated immediately beforehand by means of a milling wheel 40 arranged in the rear region of the tractor 100.

By means of a conveyor belt 45 which is attached to the side of the trench milling cutter 40, the soil material 7 which was excavated immediately beforehand is transported backwards at the same speed but in the opposite direction minus v1 (−v1) and not, as previously, deposited to the side of the just excavated cable trench 70, which contributes very substantially to the high working speed of the new method.

Immediately after the cable 3 has been deposited in the cable trench 70 and the warning tape 35 which is pulled off of an unwinding device (not shown in greater detail) in the rear attachment 101 of the tractor 100 and guided via the roller 33 has been deposited above the inserted cable 3 in the trench 70, by means of the approximately funnel-shaped ejection gutter 50, which is always arranged precisely thereabove likewise on the rear of the tractor 100, in each case a preset amount of (fine) cable sand 6 per running meter of laying stretch is allowed to flow into the trench 70 continuously, by means of which the cable 3 and the warning tape 35 deposited above said cable is embedded and surrounded and of course also covered at the top.

The soil material 7, which is conveyed backwards rü in the course of the milling of the cable trench 70 by means of the trench milling cutter 40 and the conveyor belt 45 which is attached to the side thereof at a speed minus v1 (−v1) which is in the opposite direction to the forwards driving speed v1 of the tractor 100 and is not deposited to the side of the trench 70, is reintroduced into the trench 70—immediately after the cable 3 and warning tape 35 have been embedded and surrounded with the (fine) cable sand 6—by means of the discharge chute 41 of the conveyor belt 45 to be conveyed backwards rü.

With regard to the supply and introduction of the (fine) cable sand 6 by the approximately funnel-shaped sand ejection gutter 50 attached to the rear of the tractor 100 into the cable trench 70, a second vehicle 200 is used, which drives forwards vo at a speed which is equal to the driving speed v1, in the present case a heavy goods vehicle which comprises a trough 201 containing the (fine) cable sand 6, and an externally mounted, obliquely rising sand conveyor belt 240, the outlet end 245 of which is held running precisely above the sand ejection gutter 50 of the tractor 100. The amount of (fine) cable sand which is to be introduced into the cable trench 70, provided per running meter of driving and thus cable-laying stretch, is applied to the conveyor belt 240 by means of the sand-discharge and dosing device 205 which can be controlled from the driver's cab, which is in the rear region of the trough heavy goods vehicle 200.

Both the tractor 100 and the trough heavy goods vehicle 200 which follows said tractor at the distance a at the same speed v2=v1 move forwards vo at a speed of from 0 to approximately 4 km/h in the course of the new type of cable laying. To ensure the constant and synchronous low and regulated driving speed v1=v2 of the two vehicles 100 and 200, both vehicles 100, 200 are equipped with computer-controllable hydraulic or hydrostatic transmissions.

Instead of the sand conveyor belt 240, a sand conveying hose can come up to the heavy goods vehicle 200, the open end of which is guided directly above the cable trench 70 and through which the cable sand 6 can be conveyed directly into the trench 70 by means of compressed air.

The trough heavy goods vehicle 200 shown in FIG. 2 in a rear and sectional view, which forms the second vehicle, can be a conventional, e.g. multi-axle transport vehicle for dry, fine-grained or pulverulent material, usually construction material, comprising a transport trough 12 having flanks 11 extending obliquely downwards at the angle α to one another, on the e.g. 60 cm narrow base of which a scraper conveyor 13 is moved, which can be driven by means of a motor 131, the speed of which can be controlled by means of the control unit which can be adjusted and controlled from the driver's cab of the second vehicle 200, by means of which the amount of (fine) cable sand 6 to be applied in each case per running meter is applied to a conveyor groove 16 which is oriented transversely to the vehicle axis or to the driving direction of the trough heavy goods vehicle 200, said groove having a discharge screw 17, a protrusion of which protrudes for example to the left laterally beyond the trough heavy goods vehicle 200.

The (fine) cable sand 6 conveyed by means of the discharge screw 17 is transported by a type of funnel member 204 or a hose of this type of the sand-discharge and dosing device 205 onto a conveyor belt 240 which is attached to the side of the vehicle 200 and rises upwards with the front discharge end 245 thereof over the sand discharge chute 50 (shown only by dashed lines) of the first vehicle 100 and falls through said chute in a precisely positioned manner directly into the cable trench 70 already occupied by the cable 3.

The invention claimed is:

1. A mobile device for underground laying of an elongate device, the mobile device comprising:

a milling unit with a wheel milling cutter for digging a narrow trench having a given laying depth, wherein subsoil material that is milled out of the trench by said wheel milling cutter is laterally removed, the elongate device is inserted in the trench in a determined position, fine-particle subsoil material or cable sand is introduced into the trench in order to embed the elongate device, and the previously laterally removed, milled-out subsoil material is reintroduced into the trench and recompacted;

a front vehicle configured to drive at a given speed and to feed the elongate device to be deposited for insertion into the trench in synchronicity with the given speed of the front vehicle;

said front vehicle being a carrier vehicle carrying a rear support frame with a lateral ejection unit, said milling unit with said milling wheel, and a tow-casing and cable-depositing unit following said milling unit, together forming a compact laying unit;

said compact unit including said milling unit and said milling wheel connected to said front vehicle by way of a first linkage or a rotational joint laterally offset from and beyond a contour of said front vehicle on said lateral ejection unit, enabling a lateral pivoting by a pivot angle of up to ±25° about a substantially vertical axis of rotation relative to said lateral ejection unit;

a second linkage or a rotational joint connecting said tow-casing and device-inserting and cable-sand-introduction unit following said milling unit to said milling unit so as to be laterally pivotable by an angle of up to ±25° towards both sides about a substantially vertical axis;

a conveyor belt to be loaded with the trench excavation material extending along said compact laying unit and mounted on said milling unit laterally of a milling housing;

an elongate star screen following said conveyor belt, rising obliquely backwards, said screen having a plurality of screening stars mounted on axes of rotation that are transverse to a transport direction thereof, of fine-grained trench material from coarse-grained trench material; and a conveyor belt arranged underneath said star screen and disposed to load a fine screen with the fine-particle trench material;

an ejection gutter to be guided above the trench to feed amounts of fine material or cable sand into the trench in accordance with the given speed of the front vehicle, having two drop chutes for introducing fine-grained and finest-grained trench material into the cavity of said tow-casing unit locally and temporally before the coarse-grained trench material, and wherein the coarse-grained trench material conveyed by said star screen is reintroduced into the trench immediately behind said tow-casing unit.

2. The device according to claim 1, wherein the mobile device is configured for laying underground at least one elongate device selected from the group consisting of a cable, a flexible line, a cable-drawing empty pipe, and a fluid transport hose, optionally together with a warning tape.

3. The device according to claim 1, wherein said milling unit with said milling wheel is laterally pivotable by an angle and is linked to an ejection device which is connected to said front vehicle or to said support frame thereof, and said milling unit is adaptable to topographical conditions which are defined by a surface to be undercut.

4. The device according to claim 3, wherein said milling unit is laterally displaceably, at least to one side of said front vehicle.

5. The device according to claim 4, wherein said milling unit is linearly displaceable by hydraulic drive, with respect to said front vehicle.

6. The device according to claim 1, wherein, to stabilize and keep stable walls of the trench being produced in each case, said the tow-casing and device-inserting unit are equipped with sheet metal form plates on two sides thereof, wherein a spacing distance between said plates from one another is adjustable to a respective trench width, and wherein said plates reach towards said milling wheel of said milling unit, rising in concave curves, to as short a distance as technically feasible.

7. The device according to claim 6, wherein said short distance is approximately 10 cm.

8. The device according to claim 1, wherein said milling wheel is supported so as to be lifted with respect to said milling unit by way of a mechanical system having hydraulic cylinders without changing a vertical position, within the trench, of said tow-casing and said device-inserting unit, which is connected to said milling device so as to be laterally pivotable and comprises the sheet metal form plates on both sides which ensure the stability of the trench throughout.

9. The device according to claim 8, wherein said milling wheel is lifted if said wheel is blocked by hard subsoil material.

10. The device according to claim 1, which comprises a parallelogram mechanical system for lowering or lifting said tow-casing and device-inserting unit, or for lifting said milling unit, optionally together with said milling wheel, out of the trench on occasion of a blockage, and said mechanical system is linked on both sides to said rotational joint for said tow-casing and device-inserting unit on said milling unit or on a housing thereof.

11. The device according to claim 1, wherein said conveyor belt for transporting away backwards the fine-particle trench material separated from the coarse trench material by way of said conveyor belt is arranged underneath said elongate star screen.

12. The device according to claim 11, wherein said conveyor belt is configured to load the fine screen with the fine-particle excavation material, and wherein fine-particle or finest-particle material separated from the excavation material is used at least in part instead of separately supplied cable sand, or said material is additionally used for embedding and surrounding the device being inserted in the cable trench.

13. The device according to claim 12, wherein a chute directed towards the trench for the fine-particle or finest-particle material has a variable cross section and its disposed to release a variable-height opening in a lower face thereof, and an adjustable height to be adjusted to a demand in each case per running meter of trench and cable for fine cable-embedding and surrounding material per running meter of trench and cable.

* * * * *